United States Patent [19]

Holmes et al.

[11] Patent Number: 4,823,047

[45] Date of Patent: Apr. 18, 1989

[54] MERCURY DISPENSER FOR ARC DISCHARGE LAMPS

[75] Inventors: James L. Holmes, Montoursville, Pa.; Ralph P. Parks, Jr., Danvers, Mass.

[73] Assignee: GTE Products Corporation, Danvers, Mass.

[21] Appl. No.: 105,849

[22] Filed: Oct. 8, 1987

[51] Int. Cl.[4] ..... H01J 61.20; H01J 61/24; H01J 7/14

[52] U.S. Cl. ..... 313/546; 313/490; 313/565; 220/362

[58] Field of Search ..... 313/546, 565, 490, 564; 417/48; 220/362, 201, 202; 222/451; 445/21

[56] References Cited

U.S. PATENT DOCUMENTS

| | | | |
|---|---|---|---|
| 2,283,189 | 5/1942 | Cox | 313/546 |
| 2,288,253 | 6/1942 | Reuter | 417/48 X |
| 3,230,027 | 1/1966 | Mayer | 313/546 X |
| 3,895,709 | 7/1975 | Przybylek | 313/546 X |
| 4,282,455 | 8/1981 | Latassa et al. | 313/546 X |
| 4,427,919 | 1/1984 | Grendfell | 313/546 |

*Primary Examiner*—Palmer C. DeMeo
*Attorney, Agent, or Firm*—Carlo S. Bessone

[57] ABSTRACT

A mercury capsule for dispensing mercury into an arc discharge lamp comprises an annealed metal member having a predetermined wall thickness and including a generally tubular main body portion containing a predetermined amount of mercury and a sealed end portion adjacent the main body portion. Means for sealing the end portion includes a flattened, generally planar configuration having at least one sealing constriction formed in the end portion. The sealing constriction has a defined cross-sectional thickness relative to the wall thickness and enables containment of the mercury within the capsule below a predetermined elevated temperature. Preferably, the predetermined cross-sectional thickness of the constriction is less than or equal to about two-thirds of the wall thickness of the metal member.

13 Claims, 2 Drawing Sheets

MERCURY DISPENSER FOR ARC DISCHARGE LAMPS

CROSS-REFERENCE TO OTHER APPLICATIONS

U.S. patent application Ser. No. 796,362 filed Nov. 8, 1985, now U.S. Pat. No. 4,754,193, and assigned to the same assignee as the present application contains related subject matter.

TECHNICAL FIELD

This invention relates to low pressure arc discharge lamps, particularly fluorescent lamps, which contain mercury. It is especially concerned with the means by which mercury is introduced into the lamp.

BACKGROUND OF THE INVENTION

Fluorescent lamps are well-known in the art and are used for a variety of types of lighting installations. Such lamps are characterized as low pressure discharge lamps and include an elongated envelope whose interior surface is coated with a phosphor such as calcium halophosphate, zinc silicate or calcium tungstate, and an electrode at each end of the envelope. The envelope also contains a quantity of an ionizable medium such as mercury, and a starting gas at a low pressure, generally in the range of 1 to 5 mm Hg. The starting gas may consist of argon, neon, helium, krypton or a combination thereof.

One of the most commonly used methods for introducing mercury into such lamps is a mechanical dispensing unit which forms part of so-called exhaust machine. Mercury is dispensed by the action of a slotted plunger passing through a reservoir of mercury and into the closed exhaust chamber housing the exhaust tube. The mercury falls through the exhaust tube into the lamp. This method of dispensing mercury has many drawbacks. In the first place, the mercury dispensing unit complicates the exhaust machine. In the second place, the mercury is introduced into the lamp envelope which is at a high temperature and which is in open communication with the exhaust machine. As a result, it is inevitable that a portion of the introduced mercury evaporates and disappears from the lamp, or a portion of the filling gas is driven out of the lamp. Furthermore, the introduction of mercury through the exhaust tube involves the risk of mercury getting stuck in the exhaust tube so that after sealing off the lamp it contains too little or no mercury at all. For these reasons a large excess of mercury, namely a multiple of the quantity required by the lamp is generally introduced. Finally, working with mercury on the exhaust machine requires additional safety precautions on medical grounds.

An alternative method of dispensing mercury, as shown for example in U.S. Pat. Nos. 3,657,589 and 3,728,004, is to place inside the lamp a mercury compound that is inert under lamp processing conditions but can later be activated to release mercury. Disadvantageously, this method releases impurities, which then require special gettering. It also requires a relatively long period of time (20 to 30 seconds) to activate the mercury compound. As a result, this method of dispensing mercury does not readily lend itself to high speed production machinery.

The drawbacks described hereinbefore may be obviated by placing the mercury to be introduced into the lamp in a closed capsule mounted within the lamp, whereafter the lamp is provided with the desired fill gas and is subsequently sealed. The mercury containing capsule is not opened until all manufacturing steps relating to the exhaust process have been completed.

The above-mentioned mercury capsules are generally fabricated from glass or metal. Examples of mercury containing glass capsules are shown for example in U.S. Pat. Nos. 2,415,895; 2,991,387; 3,764,842; 3,794,402; 4,182,971 and 4,335,326. These examples require special heaters proximate the capsule or an additional capsule shield to prevent loose capsule particles within the lamp upon capsule rupture.

Examples of mercury-containing metal capsules are shown for example in U.S. Pat. Nos. 2,288,253; 2,322,421; 3,300,037; 3,895,709; 3,913,999; 3,983,439; 4,056,750 and 4,282,455; and Great Britain patent application No. 2,040,554A. The metal mercury capsules contain at least one end portion sealed by flat crimping or cold welding followed in some instances by resistance welding. The disadvantages of the above methods of sealing the end portion of the metal capsules include the inability to accurately control the desired temperature at which the mercury is released from the capsule. The type of seals used in the mercury capsule must be capable of withstanding the temperatures of the glass sealing operation during the lamp manufacturing process which can exceed 300° C. Flat crimping or cold welding the mercury capsule has been found to be insufficient to repeatably contain all of the mercury within the capsule during these relatively high temperatures. Some of the methods of sealing the mercury capsule, for example, U.S. Pat. Nos. 3,895,709 and 3,913,999 which use resistance and/or cold welds, necessitate the need for expensive laser equipment to release the mercury within the capsule.

It has been discovered that in some crimping techniques, once the crimp seal is applied to the mercury-containing capsule, the seal has a tendency to open or spring back leaving a channel of approximately 0.001 inch (0.025 millimeter) due to the crimp configuration and the physical properties of the capsule material. This channel in the capsule seal prevents the retention of 100 percent of the mercury in the capsule during lamp manufacturing.

SUMMARY OF THE INVENTION

It is, therefore, an object of the invention to obviate the disadvantages of the prior art.

It is another object of the invention to provide an improved mercury capsule capable of retaining the mercury therewithin at temperatures below a given elevated temperature.

It is another object of the invention to enhance the dispensing of mercury in an arc discharge lamp.

It is still another object of the invention to provide a mercury dispenser in an arc discharge lamp which can be produced on high speed manufacturing equipment.

It is still another object of the invention to provide an improved means for controlling the temperature at which the mercury is released from a mercury capsule.

These objects are accomplished, in one aspect of the invention, by the provision of a mercury capsule comprising an annealed metal member having a predetermined wall thickness and including a generally tubular main body portion which contains a predetermined amount of mercury to be released therefrom. A sealed end portion is located immediately adjacent the main body portion for providing a seal for the capsule. A means for sealing the end portion has a flattened, generally planar configuration and includes at least one sealing constriction formed in the end portion. The sealing constriction has a predetermined cross-sectional thickness and enables containment of the mercury within the capsule below a predetermined elevated temperature.

In accordance with further aspects of the present invention, the end portion contains a plurality of sealing constrictions axially spaced along the end portion for enabling containment of the mercury within the capsule below a predetermined elevated temperature.

In accordance with the teachings of the invention, the predetermined cross-sectional thickness of the constriction is less than the predetermined wall thickness of the metal member. Preferably, the predetermined cross-sectional thickness of the sealing constriction is less than or equal to about two-thirds of the predetermined wall thickness of the metal member.

In accordance with another aspect of the present invention, there is defined a mercury member having a wall thickness of approximately 0.0030 inch and including a generally tubular main body portion which contains a predetermined amount of mercury to be released therefrom. A sealed end portion is located immediately adjacent the main body portion for providing a seal for the capsule. A means for sealing the end portion has a flattened, generally planar configuration and includes at least one sealing constriction formed in the end portion. The sealing constriction has a cross-sectional thickness of approximately 0.0020 inch and enables containment of the mercury within the capsule below a predetermined elevated temperature.

In accordance with still another aspect of the present invention, there is defined an arc discharge lamp having an envelope of light-transmitting vitreous material having opposed end portions and containing an inert starting gas. First and second electrodes are located respectively within the opposed end portions. A pair of lead-in wires are connected to the first and second electrodes.

The improvement comprises a mercury capsule secured to one of the lead-in wires. The mercury capsule includes an annealed metal member having a predetermined wall thickness and including a generally tubular main body portion for containing a predetermined amount of mercury. A sealed end portion is located immediately adjacent the main body portion for providing a seal for the capsule. A means for sealing the end portion has a flattened, generally planar configuration and includes at least one sealing constriction formed in the end portion. The sealing constriction has a predetermined cross-sectional thickness and enables containment of the mercury within the capsule below a predetermined elevated temperature, for example, within the range of from about 500° C. to about 1000° C.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
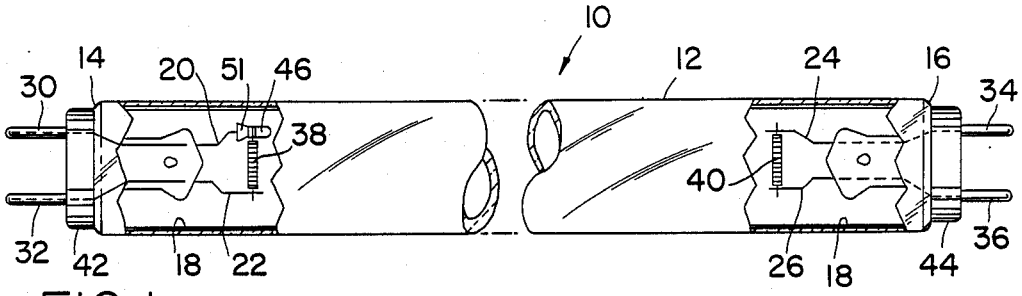
FIG. 1 is a partly broken away, perspective view of an arc discharge lamp containing a mercury capsule in accordance with this invention.
Figure 2:
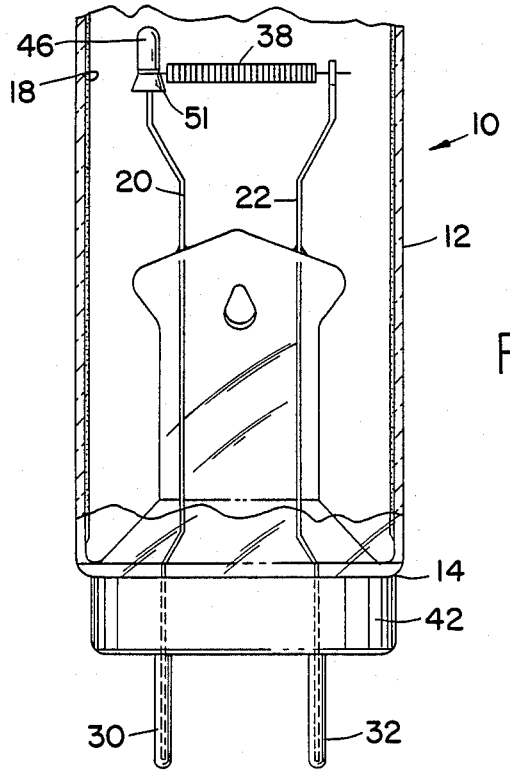
FIG. 2 is an enlarged, perspective view of a portion of the arc discharge lamp in FIG. 1.

Referring now to the drawings with greater particularity, there is shown in FIGS. 1 and 2 a fluorescent arc discharge lamp 10 having a sealed envelope 12 of light-transmitting vitreous material. Envelope 12 has opposed end portions 14, 16, and encloses an inert starting gas. The starting gas may consist of argon, neon, helium, krypton or a combination thereof at a low pressure in the range of about 1 to 5 mm Hg.

A first electrode 38 and a second electrode 40 are located within opposed end portions 14 and 16, respectively. Electrodes 38, 40 are coated with electron-emitting materials such as BaO-SrO-CaO containing $MgZrO_3$. A pair of lead-in wires 20, 22 connects electrode 38 and a pair of lead-in wires 24, 26 connect electrode 40. Suitable bases 42, 44 carrying contacts 30, 32, 34, 36 are respectively sealed adjacent end portions 14, 16. Lead-in wires 20, 22, 24, 26 are electrically connected to contacts 30, 32, 34 and 36, respectively.

A phosphor coating 18 is disposed on the interior surface of envelope 12. Phosphor coating 18, which can be a halophosphate phosphor such as Cool White, is responsive to the ultraviolet radiation generated by the plasma discharge to provide a desired emission spectrum.

In accordance with the invention and as shown in FIGS. 1 and 2, fluorescent arc discharge lamp 10 contains a mercury capsule 46 secured to lead-in wire 20 adjacent electrode 38 by welding at about spot 51.

Figure 5:
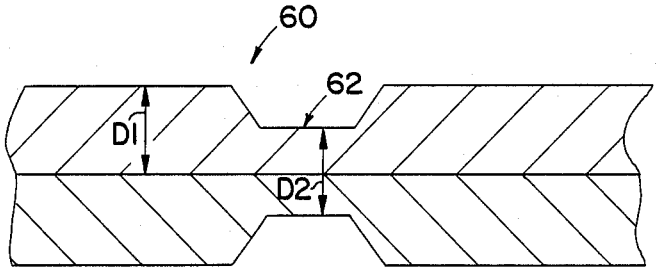
FIG. 5 is an exploded, cross-sectional partial view of one of the sealing constrictions in the mercury capsule in FIG. 3.
Figure 3:
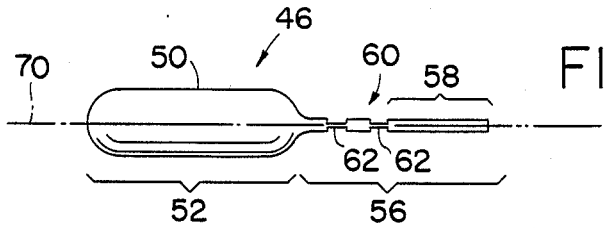
FIG. 3 is an elevational view of a mercury capsule in accordance with this invention.
Figure 4:
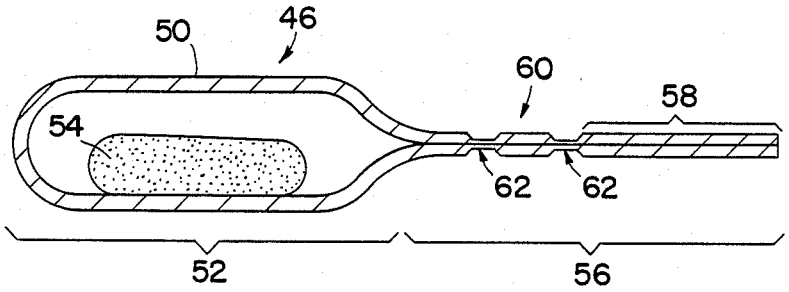
FIG. 4 is an enlarged, cross-sectional view of the mercury capsule in FIG. 3.

As best shown in FIGS. 3–5, mercury capsule 46 comprises a metal member 50 having a wall thickness D1 (FIG. 5) and including a generally tubular main body portion 52. Main body portion 52 contains therewithin a predetermined amount of mercury 54 which is released into the lamp during lamp manufacturing. A sealed end portion 56 is provided immediately adjacent main body portion 52.

End portion 56 has a flattened, generally planar configuration 60 and includes at least one sealing constriction 62 formed therein. Each sealing constriction 62 extends across the entire surface of end portion 56 in a direction perpendicular to the longitudinal axis 70 of mercury capsule 46. As best shown in FIG. 5, sealing constriction 62, which has a cross-sectional thickness D2, enables containment of mercury 54 within capsule 46 below a predetermined elevated temperature. If desired, a plurality of sealing constrictions 62 may be formed in end portion 56 and axially spaced therealong between main body portion 52 and a flattened tail portion 58.

Cross-sectional thickness D2 of constriction 62 should be less than the wall thickness D1 of metal member 50. Preferably, D2 should be less than or equal to about two-thirds of the wall thickness D1 of metal member 50.

It was discovered that annealing metal cup 46 before forming the sealing constriction of the present invention, prevents the walls of the sealed end portion from springing back immediately after the constriction is formed. Springing back of the sealed end portion creates a thin longitudinal channel through the end portion allowing mercury to escape therethrough below the desired elevated temperature. It was found that increasing the crimping pressure (without annealing) in an attempt to prevent the channel from being formed, undesirably weakens the metal in the area of the constriction.

The preferred annealing procedure includes vacuum firing the metal cups for about 45 minutes at a temperature of approximately 900° C. followed by cooling. Preferably, the cooling phase includes cooling the metal cups for about 25 minutes in an atmosphere of an inert gas at a pressure above atmosphere (e.g., 800 mm Hg). Thereafter, the metal cups are cooled at room temperature for about 30 minutes. Annealing the metal cups according to the above procedure alters the properties of the capsules by softening and by removing some of the resiliency of the metal. The metal thereafter can be deformed more easily during the formation of the sealing constriction without having the walls of the end portion spring back. Microscopic photographs of the grain structure in the cross section of a constriction formed in an annealed capsule indicate the absence of both stress lines in the metal and the thin longitudinal channel normally found when using other crimping techniques.

Figure 7:
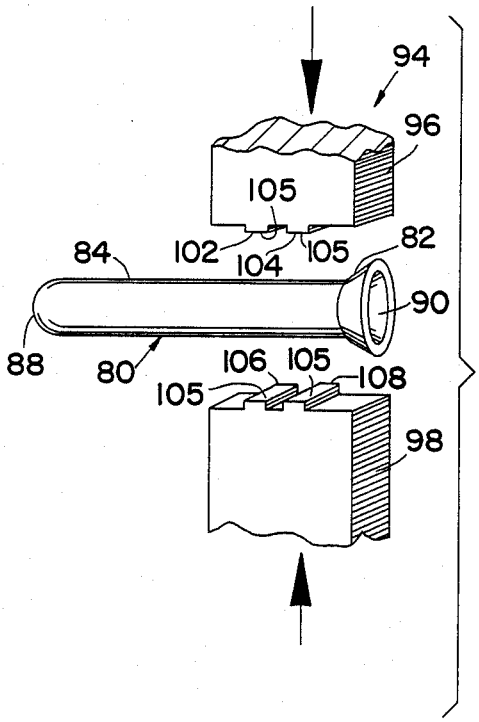
FIG. 7 is a perspective view of the metal cup in FIG. 5 along with a crimping tool used in sealing the metal cup.
Figure 6:
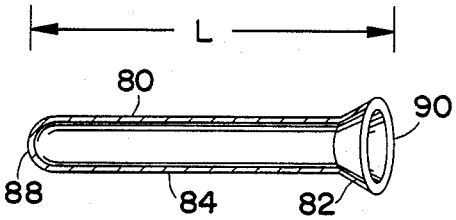
FIG. 6 is a cross-sectional view of a preferred embodiment of a metal cup before crimping having a larger diameter skirted portion and a smaller diameter portion.

As shown in FIGS. 6 and 7, according to the preferred method for the manufacture of the invention, mercury capsule 46 is formed from a generally tubular metal cup 80 of predetermined length L having a closed end 88 formed therein and an opened end 90. Preferably cup 80 has a larger diameter skirted portion 82 and a smaller diameter portion 84. An advantage of a double diameter cup over a single diameter cup is that the double diameter provides an advantageous means for orienting the cup prior to mercury filling. In addition, the larger diameter provides a greater target area for both mercury filing and welding to the lead-in wire, while the smaller diameter provides an advantageous means for faster transfer and feeding on manufacturing equipment.

Approximately 14 to 16 milligrams of mercury is dispensed into cup 80 through open end 90.

A sealed end portion 56 as shown in FIGS. 3–5 is formed by crimping open end 90 of cup 80 with a crimping tool 94 (FIG. 7) having an upper section 96 and a lower section 98. Equal pressure is applied to the same area on both sides of the end portion of the capsule to be sealed. The crimping pressure should be within the range of from about 600,000 to 800,000 pounds per square inch (psi). Upper section 96 is shown as having a plurality of teeth 102, 104 each having a surface which aligns with a respective surface on teeth 106, 108 on lower section 98. For example, surface 105 on tooth 102 aligns with surface 105 on tooth 106. The width, shape and number of teeth on crimping tool 94 can be adjusted to obtain the desired configuration (i.e., number and shape of constrictions).

It has been discovered that by forming the constrictions of the present invention, the temperature at which the mercury is released from the capsule can be more accurately controlled than, for example, flat crimping or cold welding. The constrictions increase the resistance of the sealed end portion 56 thus requiring a higher mercury pressure within main body portion 52 before mercury 54 is released from capsule 46. The number of constrictions is increased or decreased in accordance with the lamp processing temperatures and the desired elevated rupture temperature. Depending on the temperatures encountered, generally one or two constrictions formed in the end portion are sufficient to contain the mercury during lamp processing and still allow the capsule to rupture at an elevated temperature encountered during the mercury releasing process. The strength of the constrictions can be controlled by adjusting the crimping pressure.

In a typical but non-limitative example, mercury capsule 46 was formed from a generally tubular metal cup 80 made from Alloy 4 and having a smaller diameter portion 84 of 0.060 inch (1.52 millimeters) outer diameter (O.D.), a wall thickness of approximately 0.0030 inch (0.076 millimeter) and a length L of 0.400 inch (1.016 centimeters). Metal cup 80 had a larger diameter skirted portion 82 with a maximum diameter of approximately 0.125 inch (3.175 millimeters). Prior to sealing, the metal cup was annealed by vacuum firing at a temperature of about 900° C. for about 45 minutes. Thereafter, the metal cup was subjected to an argon atmosphere for about 25 minutes at a pressure of about 800 mm Hg. After cooling to room temperature, approximately 16 milligrams of mercury was dispensed into the cup through the open end 90. A sealed end portion was formed by crimping at a crimping pressure of approximately 700,000 pounds per square inch (psi) using a crimping tool to form a single constriction in the smaller diameter portion 84. The sealed end portion further included a flattened tail portion located immediately adjacent the constriction and remote from the main body portion. The formed mercury capsule 46 was secured to one of the lead-in wires 20 adjacent the electrode 38 in an arc discharge fluorescent lamp 10 as shown in FIGS. 1 and 2. Fluorescent lamp 10 was a four foot T12 lamp having a 100 percent argon fill at 2.5 mm Hg.

After lamp sealing, the mercury 54 in capsule 46 can be released by heating capsule 46 to an elevated temperature sufficient to cause capsule rupture by using the apparatus shown and described in U.S. Pat. No. 4,494,042, which issued to Roche on Jan. 15, 1985 and is assigned to the Assignee of the present application.

There has thus been shown and described an improved means for accurately controlling the temperature at which mercury is released from a mercury capsule. The invention eliminates the normal tendency of the walls of the sealed end portion to spring back once a crimp seal is applied to the mercury-containing capsule.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A mercury capsule comprising:

an annealed metal member and including a generally tubular main body portion which contains a predetermined amount of mercury to be released therefrom; a sealed end portion immediately adjacent said main body portion for providing a seal for said capsule; and means for sealing said end portion, said sealing means having a flattened, generally planar configuration and including a flattened portion consisting of a pair of walls, one of said walls having a predetermined wall thickness, and at least one sealing constriction formed in said flattened portion, said sealing constriction having a predetermined cross-sectional thickness less than said predetermined wall thickness of said one of said walls at said flattened portion, said sealing constriction enabling containment of said mercury within said capsule below a predetermined elevated temperature.

2. The mercury capsule of claim 1 wherein said end portion contains a plurality of sealing constrictions axially spaced along said end portion, said sealing constrictions enabling containment of said mercury within said capsule below a predetermined elevated temperature.

3. The mercury capsule of claim 1 wherein said predetermined cross-sectional thickness of said sealing constriction is less than or equal to about two-thirds of said predetermined wall thickness of said flattened portion.

4. The mercury capsule of claim 1 wherein said predetermined wall thickness of said flattened portion is within the range of from about 0.0025 inch to about 0.0035 inch.

5. The mercury capsule of claim 4 wherein said predetermined wall thickness of said flattened portion is equal to about 0.0030 inch.

6. The mercury capsule of claim 1 wherein said predetermined elevated temperature is within the range of from about 500° C. to about 1000° C.

7. A mercury capsule comprising:

an annealed metal member having a wall thickness of approximately 0.0030 inch and including a generally tubular main body portion which contains a predetermined amount of mercury to be released therefrom; a sealed end portion immediately adjacent said main body portion for providing a seal for said capsule; and means for sealing said end portion, said sealing means having a flattened, generally planar configuration and including a flattened portion consisting of a pair of walls formed from said metal member and at least one sealing constriction formed in said flattened portion, said sealing constriction having a cross-sectional thickness of approximately 0.0020 inch and enabling containment of said mercury within said capsule below a predetermined elevated temperature.

8. In an arc discharge lamp having an envelope of light-transmitting vitreous material having opposed end portions and containing an inert starting gas, a first and second electrode located within a respective one of said opposed end portions, a pair of lead-in wires connected to said first and second electrode, the improvement comprising:

a mercury capsule secured to one of said lead-in wires, said mercury capsule including an annealed metal member and including a plurality tubular main body portion for containing a predetermined amount of mercury; a sealed end portion immediately adjacent said main body portion for providing a seal for said capsule; and means for sealing said end portion, said sealing means having a flattened, generally planar configuration and including a flattened portion consisting of a pair of walls, one of said walls having a predetermined cross-sectional wall thickness and at least one sealing constriction formed in said flattened portion, said sealing constriction having a predetermined cross-sectional thickness less than said cross-sectional wall thickness of said one of said walls at said flattened portion, said sealing constriction enabling containment of said mercury within said capsule below a predetermined elevated temperature.

9. The improvement according to claim 8 wherein said end portion contains a plurality of sealing constrictions axially spaced along said end portion, said sealing constrictions enabling containment of said mercury within said capsule below a predetermined elevated temperature.

10. The improvement according to claim 8 wherein said predetermined cross-sectional thickness of said constriction is less than or equal to about two-thirds of said predetermined wall thickness of said flattened portion.

11. The improvement according to claim 8 wherein said predetermined wall thickness of said metal member is within the range of from about 0.0025 inch to about 0.0035 inch.

12. The improvement according to claim 11 wherein said predetermined wall thickness of said flattened portion is equal to about 0.0030 inch.

13. The improvement according to claim 8 wherein said predetermined elevated temperature is within the range of from about 500° C. to about 1000° C.

* * * * *